US005899281A

United States Patent [19]

Gynz-Rekowski

[11] Patent Number: 5,899,281

[45] Date of Patent: May 4, 1999

[54] ADJUSTABLE BEND CONNECTION AND METHOD FOR CONNECTING A DOWNHOLE MOTOR TO A BIT

[75] Inventor: Gunther von Gynz-Rekowski, Houston, Tex.

[73] Assignee: Pegasus Drilling Technologies L.L.C., Houston, Tex.

[21] Appl. No.: 08/861,296

[22] Filed: May 21, 1997

[51] Int. Cl.[6] ..... E21B 7/08; E21B 17/043

[52] U.S. Cl. ..... 175/74; 175/101

[58] Field of Search ..... 175/45, 61, 73, 175/74, 101, 107, 256

[56] References Cited

U.S. PATENT DOCUMENTS

| | | | |
|---|---|---|---|
| 3,961,674 | 6/1976 | Craig, Jr. et al. | 175/45 |
| 4,077,657 | 3/1978 | Trzeciak | 285/184 |
| 4,374,547 | 2/1983 | Nguyen et al. | 175/45 |
| 4,694,914 | 9/1987 | Obrecht | 175/61 |
| 5,029,654 | 7/1991 | Wilson et al. | 175/74 |
| 5,052,501 | 10/1991 | Wenzel et al. | 175/74 |
| 5,117,927 | 6/1992 | Askew | 175/61 |
| 5,125,463 | 6/1992 | Livingstone et al. | 175/74 |
| 5,269,385 | 12/1993 | Sihlis | 175/74 |
| 5,311,952 | 5/1994 | Eddison et al. | 175/61 |
| 5,314,032 | 5/1994 | Pringle et al. | 175/74 |
| 5,343,966 | 9/1994 | Wenzel et al. | 175/74 |
| 5,441,119 | 8/1995 | Head | 175/74 |
| 5,495,901 | 3/1996 | Livingstone et al. | 175/74 |
| 5,503,235 | 4/1996 | Falgout, Sr. | 175/61 |

FOREIGN PATENT DOCUMENTS

| | | | |
|---|---|---|---|
| 907212 | 2/1982 | U.S.S.R. | 175/73 |
| 1656113 | 6/1991 | U.S.S.R. | 175/256 |

OTHER PUBLICATIONS 1 page, Trudril Adjustable Bend Housing, date and source unknown.

1 page, AKO Sub figure, date and source unknown.

*Primary Examiner*—David J. Bagnell

*Attorney, Agent, or Firm*—Rosenblatt & Redano P.C.

[57] ABSTRACT

An adjustable bend connection is provided which desirably extends from the power section of a downhole progressing-cavity-type mud motor. The joint is secured internally so that any reverse rotation of the bend housings that may occur does not result in undoing the bend connection. Torque is transmitted separately from the portion of the connection which is used to secure the angle selected. The output shaft from the mud motor extends internally through the bend connection and through the components which retain the preselected angle. A tool can be inserted with the bit removed to secure or to change the angle desired.

20 Claims, 2 Drawing Sheets

ADJUSTABLE BEND CONNECTION AND METHOD FOR CONNECTING A DOWNHOLE MOTOR TO A BIT

FIELD OF THE INVENTION

The field of this invention relates to angle-adjustable and straight connections, particularly those employed in directional drilling using a downhole mud motor.

BACKGROUND OF THE INVENTION

Directional drilling is generally accomplished by putting a bend and stabilizers in the drillstring, which will allow the orientation of the drillbit and, therefore, the change of wellbore orientation. Bend connections can be of the fixed type for a particular angle. These bend connections are assembled at the surface into the drillstring and run in the wellbore and the bit is rotated by a motor so that the deviation is achieved. The bend can be created from the surface if elaborate controls and actuating mechanisms are provided so that a signal from the surface actuates movement downhole to create the bend as desired. Typical of such devices are U.S. Pat. Nos. 5,441,119; 4,374,547; 5,503,235; 5,117,927; and 5,311,952. Some designs depend on rotation to the left to create a bend connection. This design is illustrated in U.S. Pat. No. 4,694,914. Other designs involve external wedges which are used to predetermine the angle of the bend. Such a design is illustrated in U.S. Pat. No. 5,314,032. Other designs allow the creation of a variety of angles, with an internal bolt to secure the angle selected, coupled with an external thread to connect the two components which are used to create the bend. Typical of such a design is U.S. Pat. No. 4,077,657. This is not a design which is usable between a power section and a bearing section of a downhole motor which has a driveline through it. It is advantageous to place the bend connection close to the bit. Designs, such as shown in U.S. Pat. No. 4,077,657, is used in the area of drill collars which are uphole from the downhole motor.

It is desirable to put the bend connection as close to the bit as possible, and the preferred location is generally between the power section of the mud motor, which can be a progressive cavity-type of a motor, also known as Moineau, and the bit. One of the situations that occurs when drilling with a mud motor is that the bit, which is normally driven by the mud motor to the right, will wear out and develop an undersized OD. Therefore, the hole size will be reduced and the lower motor housing can become stuck. When such conditions occur, if the string is released at the rotary table at the surface, accumulated torsion in the drillstring will be released so that a reverse rotation to the left occurs. If the string is picked up at the surface, the bit is released and it rotates to the right and passes a neutral position, which results in a subsequent rotation to the left. Threaded joints in the area of the bend connection of the mud motor can, as a result of this reverse rotation to the left, become undone. These joints are typically the connections with the lowest make-up torque in the whole drillstring and therefore have the lowest resistance to reverse rotation to the left. Accordingly, for bend connections which are disposed between the power section of the downhole mud motor and the bit, it is desirable to be able to select the desired angle and put the bend connection together in such a way that it will not be subjected to becoming disconnected upon reverse rotation of the drilistring, which could result in dropping the bit and the lower parts of the motor in the wellbore. Thus, the object of the invention is to provide a simple design for manual selection at the surface of the predetermined angle which will be employed for further drilling of the wellbore, while at the same time presenting a bend connection that can easily transmit torque, regardless of the angle which is selected. These and other desirable features of the invention will become apparent by a review of the enclosed drawings and the description of the preferred embodiment.

SUMMARY OF THE INVENTION

An adjustable bend connection is provided which desirably extends from the power section of a downhole progressing-cavity-type mud motor. The joint is secured internally so that any reverse rotation of the bend housings that may occur does not result in undoing the bend connection. Torque is transmitted separately from the portion of the connection which is used to secure the angle selected. The output shaft from the mud motor extends internally through the bend connection and through the components which retain the preselected angle. A tool can be inserted with the bit removed to secure or to change the angle desired.

DETAILED DESCRIPTION OF THE PREFERRED EMBODIMENT

Figure 1:
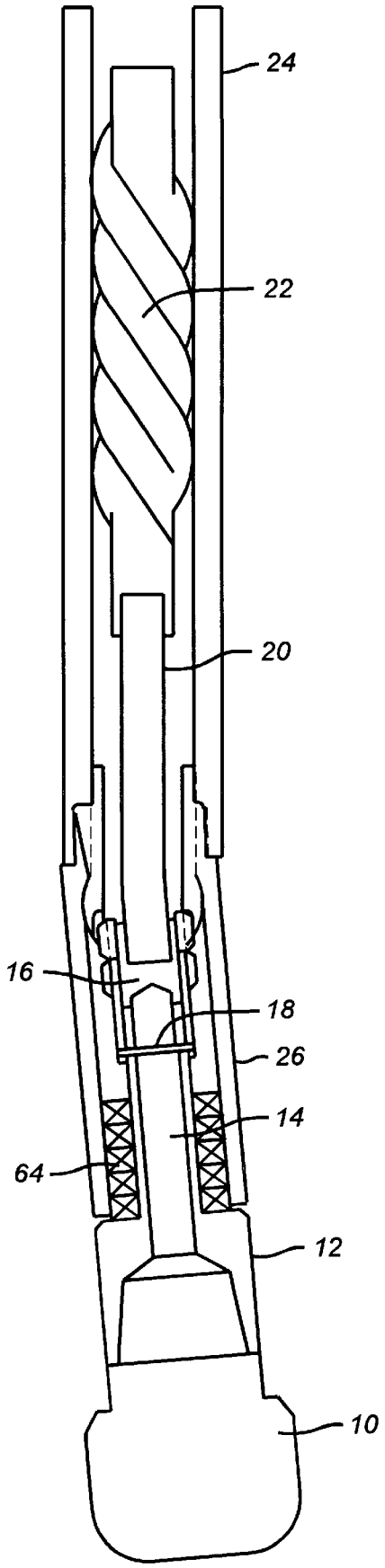
FIG. 1 is a sectional elevational view of a bottomhole assembly, illustrating the bend connection of the present invention.

Referring to FIG. 1, the bit 10 is threaded to the bit box 12, through which extends a hollow shaft 14. On top of shaft 14 is axially movably mounted a coupling or screw lock 16. The end of the shaft 14 is doweled by dowel 18 to the coupling 16. Dowel 18 also secures sleeve 19, shown in FIG. 2, which is part of coupling 16 and has lugs 52 thereon. Spring 21 bears on inner surface 23 of shaft 14 and at the other end to dowel 18. Sleeve 19 with dowel 18 are movable with respect to shaft 14. Spring 21 biases lugs 52 away from recesses 54 during normal operation. A tool T can overcome spring 21 to push lugs 52 into recesses 54.

Figure 2:
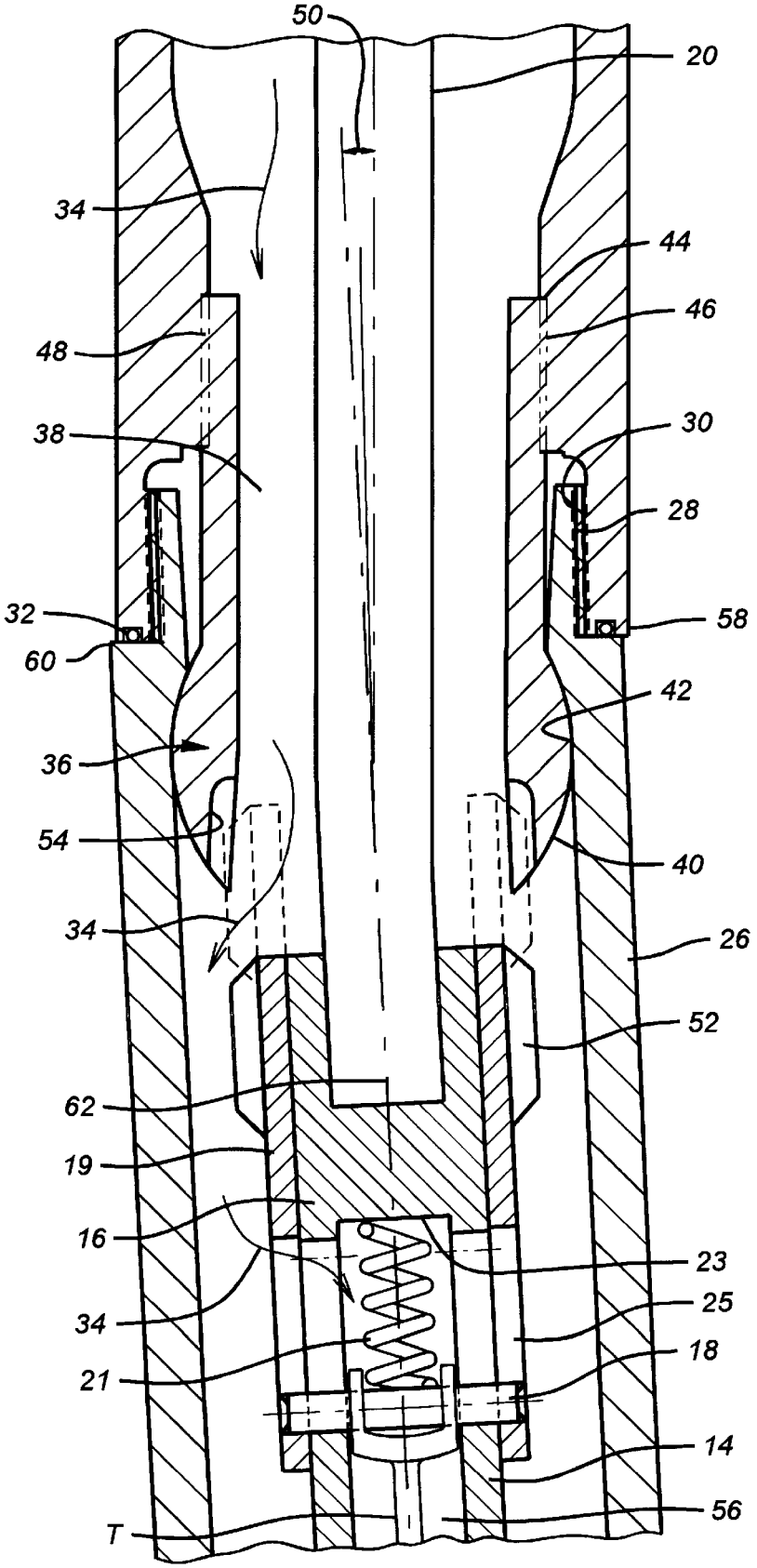
FIG. 2 is a detailed view of a portion of FIG. 1.

Also connected to shaft 14 is output shaft 20, which extends from the rotor 22. Taken together, this is the inner driveline. Housing 26 extends to the bearings 64. Taken together, the housings 24 and 26 extend from the power section, i.e., around rotor 22, to the bearing section, i.e., above bearings 64. The drive, which includes shaft 20 down to shaft 14, extends to the bit 10. The upper housing 24 constitutes the stator for the rotor 22. As illustrated in FIG. 1, the mud motor is a conventional Moineau-type pump, having a progressing cavity created between the rotor 22 and the stator, which is part of the housing 24, so that the rotor 22 along with the shaft 20 rotate upon mud flow through the upper housing 24. Referring to FIG. 2 for greater detail, the upper housing 24 is connected to the lower housing 26 through a series of splines 28 extending into matching grooves 30. Thus, the housings 24 and 26 rotate in tandem with torque being transmitted through the connection of splines 28 in grooves 30. A seal 32 can be mounted between the housings 24 and 26 to prevent escape of mud which is being pumped in the direction of arrows 34 through ports 25 and down to bit 10.

The angle between housings 24 and 26 is determined through the use of a sleeve 36. Sleeve 36 has a central bore 38 through which output shaft 20 extends. Sleeve 36 has preferably a spherical shape 40 at its lower end which interacts with shoulder 42 on lower housing 26. The upper end 44 has a thread 46 which engages a thread 48 on upper housing 24. By virtue of the ball and socket orientation of spherical section 40, interacting with shoulder 42, various orientations between the housings 24 and 26 can be obtained to achieve the desired bend angle, as indicated by arrow 50.

In order to select an angle, the two housings 24 and 26 are moved into alignment so that the splines 28 loosely engage the grooves 30. The sleeve 19 has a plurality of lugs 52 which can selectively engage matching recesses 54 within the spherical end 40 of sleeve 36. In order to secure a preselected angle between the housings 24 and 26, the bit 10 can be removed. Access is then available into passage 56 of shaft 14 so that the sleeve 19 can be translated with a tool, shown schematically as T. Tool T pushes against dowel 18 and compresses spring 21. If bit box 12 is now turned, it also turns sleeve 19 with lugs 52 in recesses 54. With translation of the sleeve 19, the lugs 52 engage the recesses 54 and a rotational force applied to bit box 12 secures the threads 46 and 48. As a result, the upper housing 24 is drawn against the lower housing 26 as the threads 46 and 48 are made up. Ultimately, further relative movement between the housings 24 and 26 can no longer occur as the two housing components engage each other and spherical shape 40 is in contact with shoulder 42. At that time, the spherical surface 40, interacting with the shoulder 42, secures the position of initial contact between the upper housing 24 and the lower housing 26. At that point, the tool T is withdrawn, allowing spring 21 to hold lugs 52 out of recesses 54 and the bit 10 is reassembled. Dashed lines in FIG. 2 illustrate the displacement of the sleeve 19 by the tool T to secure the sleeve 36 to the upper housing 24.

It should be noted that a variety of angles indicated by arrow 50 can be obtained, including the angle zero (0) for vertical drilling. The illustrated device is simple to set at a desired angle and illustrates the placement of the bend connection between the power section of the downhole motor and the bit 10, where it is most desirable to have such a bend connection. The seal 32 can take a variety of forms and is an optional feature in the assembly.

It should be noted that the lower end 58 of upper housing 24 and the upper end 60 are both preferably cut at a plane that is not perpendicular to the longitudinal axis 62. Thus, depending on the manner in which the housings 24 and 26 are brought together, they can be made to align so that the angle represented by arrow 50 is zero for vertical drilling up to a maximum angle represented by the sum of the offset angles of the lower end 58 and the upper end 60 with respect to the longitudinal axis 62. Thus, the range of the angle of the bend can be modified by the angle of the cut of the ends 58 and 60. A sufficient number of splines 28 and matching grooves 30 can be provided so that a plurality of predetermined relative orientations between the housings 24 and 26 can be selected and subsequently secured by rotation of sleeve 36, making up threads 46 and 48 and ultimately shouldering spherical surface 40 on shoulder 42.

It should be noted that when the bend connection of the present invention is made up, the shaft 20 extends through sleeve 36 to coupling 16, which connects to the bit 10 through the shaft 14. A plurality of bearings 64 act as radial and thrust bearings for the shaft 14. Thus, with the bit 10 assembled, the sleeve 19 cannot engage the sleeve 36 where a potential damage to sleeve 36 and recesses 54 might occur from lugs 52. Thus, when fully assembled as shown in FIG. 2, the sleeve 19 cannot move to the position indicated in dashed lines in FIG. 2, and the bend connection retains the preselected angle represented by arrow 50.

Those skilled in the art will appreciate that the adjustable bend connection illustrated is a simple construction which allows the bend connection to be placed between the rotor 22 and the bit 10. There are no external threads that could be undone if the housings 24 and 26 encounter conditions where reverse rotation occurs. Additionally, the splines 28 extending into grooves 30 transmit torque so that the sleeve 36, which holds the joint together at threads 46 and 48, is not subjected to the significant torques which can be passed from the lower housing 26 to the upper housing 24. Depending on the cut of lower end 58 and upper end 60, a variety of angles can be obtained as desired. The angle can be readily changed if the bit 10 is removed and the tool T releases sleeve 36 at threads 46 and 48, which allows splines 28 to exit matching grooves 30, thus permitting relative rotation of the housings 24 and 26 until a new position is selected and the sleeve 36 is refastened. Thus, for the adjustable bend connections of the manual type, which are changeable upon removal from the wellbore, the disclosed design of adjustable bend connections, suitable for use with downhole mud motors, represents a significant improvement in that the risk of losing the bit and other parts of the bottomhole assembly due to a reverse rotation are eliminated. At the same time, flow through the connection is possible. The joint is as strong as the remainder of the string through the use of splines 28 which transmit torque. Splines 28 can be oriented radially or at another angle without departing from the spirit of the invention.

The foregoing disclosure and description of the invention are illustrative and explanatory thereof, and various changes in the size, shape and materials, as well as in the details of the illustrated construction, may be made without departing from the spirit of the invention.

I claim:

1. A bend connection from adjacent a power section of a downhole motor connected to a bit for directional drilling, comprising:

an upper tubular housing having a longitudinal axis and a lower end;

a lower tubular housing having a longitudinal axis and an upper end;

a locking member mounted internally to at least one of said housings;

at least one of said ends oriented in an oblique plane to the respective longitudinal axis such that a variety of angular orientations between said housings can be accomplished by abutting said ends after a predetermined relative rotation about one of said longitudinal axes;

said housings, which extend from adjacent the power section of said downhole motor, are longitudinally secured by said locking member from within one of said housings to selectively hold said ends of said housings together at the preselected angular position of said longitudinal axes, while at the same time allowing a drive between the power section and the bit to extend therethrough.

2. The connection of claim 1, further comprising:

a direct connection between said housings that precludes relative rotation between them, independent of said locking member.

3. The connection of claim 2, wherein:

said direct connection comprises at least one spline on one of said housings extending into at least one groove on the other of said housings.

4. The connection of claim 3, wherein:

said spline and mating groove are substantially perpendicular to said end of said housing on which they respectively appear.

5. A bend connection from adjacent a power section of a downhole motor connected to a bit for directional drilling, comprising:

an upper tubular housing having a longitudinal axis and a lower end;

a lower tubular housing having a longitudinal axis and an upper end;

a locking member mounted internally to at least one of said housings;

at least one of said ends oriented in an oblique plane to the respective longitudinal axis such that a variety of angular orientations between said housings can be accomplished by abutting said ends after a predetermined relative rotation about one of said longitudinal axes;

said housings, which extend from adjacent the power section of said downhole motor, are longitudinally secured by said locking member from within one of said housings to selectively hold said ends of said housings together at the preselected angular position of said longitudinal axes, while at the same time allowing a drive between the power section and the bit to extend therethrough; and said locking member comprises a tubular element defining a passage therethrough having an elongated body with a shoulder and a fastening feature, said fastening feature engages one of said housings and draws said shoulder against the other of said housings until said lower and upper ends are in firm contact.

6. The connection of claim 5, wherein:

said fastening feature comprises a thread on one end of said tubular element;

one of said housings further comprises a mating thread for engaging the thread of said tubular element;

the other of said housings comprises a rounded shoulder, said shoulder on said tubular element having a conforming rounded shape such that upon make-up of said threads, said rounded shoulders are drawn into contact until said ends of said housings are pulled into contact at the desired angle between said longitudinal axes.

7. The connection of claim 6, wherein:

said locking member further comprises a second shoulder adjacent said passage to allow actuation of said fastening feature from within one of said housings so as to bring said upper and lower ends into firm contact.

8. The connection of claim 7, further comprising:

a direct connection between said housings that precludes relative rotation between them, independent of said locking member.

9. The connection of claim 8, wherein:

said direct connection comprises at least one spline on one of said housings extending into at least one groove on the other of said housings.

10. The connection of claim 9, wherein:

said spline and mating groove are substantially perpendicular to said end of said housing on which they respectively appear.

11. The connection of claim 5, wherein:

said locking member further comprises a second shoulder adjacent said passage to allow actuation of said fastening feature from within one of said housings so as to bring said upper and lower ends into firm contact.

12. A method for connecting a downhole motor to a bit using a bend connection, comprising:

inserting a first portion of an inner driveline through a first housing and a locking member;

connecting the bit to a coupling with another portion of said inner driveline in a second housing;

securing said first portion of said driveline to said coupling within said housings;

securing said first and second housings with said locking member from within one of said housings at a predetermined orientation between them.

13. The method of claim 12, further comprising:

providing an independent engagement of said housings from said locking member for the purpose of transmission of torque between said housings.

14. The method of claim 13, further comprising:

using said coupling to actuate said locking member.

15. The method of claim 14, further comprising:

providing a lower end on said first housing and an upper end on said second housing;

orienting said ends in planes that are not perpendicular to the longitudinal axes of said first and second housings;

obtaining a predetermined bend angle between said longitudinal axes by bringing said ends together in a particular alignment;

holding said angle by securing said locking member with said ends abutting.

16. A method for connecting a downhole motor to a bit using a bend connection, comprising:

inserting a first portion of an inner driveline through a first housing and a locking member;

connecting the bit to a coupling with another portion of said inner driveline in a second housing;

securing said first portion of said driveline to said coupling within said housings;

securing said first and second housings with said locking member from within one of said housings at a predetermined orientation between them;

providing a thread and a rounded shoulder on said locking member;

providing a mating thread in said first housing and a mating rounded shoulder in said second housing;

rotating said locking member with said coupling to make up said threads and engage said shoulders.

17. The method of claim 16, further comprising:

providing a socket on one end of said locking member;

providing a biased component on said coupling having a lug thereon for selective engagement of said socket;

accessing said biased component of said coupling with a tool insertable through said second housing after removal of said bit.

18. The method of claim 17, further comprising:

providing a plurality of splines on said first housing and recesses on said second housing so as to facilitate bringing said ends together in a variety of predetermined angles of said longitudinal axes while said splines engage said recesses.

19. The method of claim 18, further comprising:

providing a seal between said ends when they are brought together;

orienting said splines substantially perpendicular to said end of said first housing; and orienting said recesses substantially perpendicular to said end of said second housing.

20. The method of claim 16, further comprising:

securing said housings to each other without external threads which can be undone if the bit encounters reverse rotation.

* * * * *